US005205033A

United States Patent [19]

Drach

[11] Patent Number: 5,205,033

[45] Date of Patent: Apr. 27, 1993

[54] TOOL FOR ASSEMBLING MULTIPLE CONDUCTOR CONNECTORS

[75] Inventor: Robert G. Drach, Douglas, Nebr.

[73] Assignee: AT&T Bell Laboratories, Murray Hill, N.J.

[21] Appl. No.: 843,866

[22] Filed: Feb. 27, 1992

[51] Int. Cl.[5] ..... H01R 43/04

[52] U.S. Cl. ..... 29/749; 29/566.3; 29/753

[58] Field of Search ..... 29/749, 751, 753, 566.3, 29/566.4

[56] References Cited

U.S. PATENT DOCUMENTS 4,148,138 4/1979 Becker et al. ..... 29/749

*Primary Examiner*—Carl E. Hall

*Attorney, Agent, or Firm*—Donald E. Hayes, Jr.

[57] ABSTRACT

A tool (150) for assembling stackable elements (52, 54 and 58) to form a multiple conductor connector (50). A holding bracket assembly (100) is incorporated in the tool (150) to prohibit undesirable movement of the lowermost connector element (52) and to maintain alignment of the various elements of the connector (50) during the connectorization process.

At least one protrusion (112) is manipulated into physical engagement with a side portion of the lowermost connector element (52). The protrusion (112) is spring-loaded and includes a sharp, tapered edge constructed of hardened material which provides a position-securing force to the connector (50) by becoming embedded into the side portion of the lowermost connector element (52). In addition, a second protrusion (110) is aligned opposite each of the sharp protrusions (112) and capable of providing an additional position-securing force to a second side portion of the lowermost connector element (52).

6 Claims, 5 Drawing Sheets

TOOL FOR ASSEMBLING MULTIPLE CONDUCTOR CONNECTORS

TECHNICAL FIELD

This invention relates to a tool for assembling multiple conductor connectors having an improved holding bracket for use therein. More particularly, the holding bracket of the tool comprises a slidably moveable securing means capable of engaging a lower most component of the connector so as to prevent movement of the connector relative to the tool during the conductor connecting process.

BACKGROUND OF THE INVENTION

A number of different devices are available for use in the communications industry to connect corresponding conductors of two cables at a splice location. As the number of conductors to be connected together in any one application increased, the industry resorted to multiple contact connectors. Examples of such multiple contact connectors are shown in U.S. Pat. No. 3,858,158 which issued Dec. 31, 1974 in the names of Henn, et al., and in U.S. Pat. 3,722,635 which issued Nov. 13, 1973, in the names of D. R. Frey, et al., and which are expressly incorporated by reference herein.

The particular type of multiple contact connectors referenced above have received tremendous acceptance throughout the communications industry. It has been estimated that over two billion pair splice connections are made each year by the telephone industry. Furthermore, a large number of such connections are made with the type of connectors disclosed in the above-identified patents.

The multiple contact connector disclosed in U.S. Pat. No. 3,858,158 is commonly referred to as a stackable connector and includes an index strip and a connector module. The connector module includes a plurality of metallic contact elements each having oppositely disposed conductor-receiving slots. In use, an installer positions an index strip in an assembly tool and insulated conductors from a first group transversely of the index strip in a plurality of conductor-receiving grooves. The conductors are seated in the grooves after which a connector module is positioned above the index strip and secured thereto which causes the conductors to be moved into conductor-receiving slots of the contact elements which extend below the module. Conductors of a second group which are to be spliced to those of the first group are inserted into conductor-receiving grooves of the connector module and the tool is operated to seat those conductors in upper conductor-receiving slots of the contact elements.

Various types of tools have been utilized to assemble the conductors to a connector. As may be apparent, such tools must be portable and uncomplicated, yet capable of imparting sufficient forces to the conductors to secure them to the connector within the associated tight-fitting recesses, as well as being capable of severing excess lengths of the conductors. Notably, U.S. Pat. No. 4,148,138 which issued on Apr. 10, 1979, in the name of Becker, et al., U.S. Pat. No. 4,282,644 which issued on Aug. 11, 1981, in the name of E. H. Petree and U.S. Pat. No. 4,384,402 which issued on May 24, 1983, also in the name of E. H. Petree, satisfy the above-stated requirements for assembling multiple contact stackable connectors. In general, each of these patents disclose a hand-operated tool which automatically positions a tool head with respect to each stage of assembly of a stackable connector to control the application of forces required at each stage during the connectorization process. It should also be noted that cam-activated hydraulic systems are also presently used to assemble multiple contact stackable connectors. An example of such a hydraulic tool is the 890E Cam-Draulic Tool disclosed in an AT&T marketing brochure dated March, 1989.

More specifically, the aforementioned tools incorporate a holding bracket configured to secure and align an index strip portion of the stackable connector relative to the tool. For an acceptable splice to be created between the multiple conductors, the alignment of the connector module relative to the index strip throughout the process is critical.

In the above-described tools, the connectorization process involves moving the connector module and its associated conductors toward a stationary index strip. Due to all the various movements involved, the index strip is subjected to a variety of forces during connection. Such forces often cause the index strip to move relative to the connector module and/or cap, which as stated earlier, is highly undesirable. Some existing tools have attempted to prevent movement of the index strip by incorporating a spring-activated plate within the holding bracket. The plate may be slidably positioned over a ledge on the base of the index strip, thereby discouraging upward movement of the index strip during operation of the tool.

However, the plate of the holding bracket disclosed in the above-identified prior art does not adequately prohibit all undesirable motion of index strip. The prior art seemingly does not include means to alleviate the lateral swaying, bowing or rocking motion to which the index strip is often subjected. Therefore, a sought-after holding bracket should sufficiently restrict all motion of the index strip relative to the tool. In addition, the sought-after holding bracket should be rugged and uncomplicated since tools for assembling multiple contact connectors and conductors are often operated in manholes, on telephone poles, in crowded central offices or other awkward operating environments.

SUMMARY OF THE INVENTION

The foregoing problems are overcome by tool in accordance with the present invention. The tool described herein for simultaneously securing a plurality of conductors to a connector element includes an improved holding bracket which prohibits movement of the index strip relative to the tool during the connectorization process.

In general, a tool in accordance with the present invention includes an improved holding bracket which comprises means for applying a position-securing force to each side of the index strip. Such forces act to alleviate lateral swaying, rocking or bowing frequently encountered by the index strip during the operation of the connecting tool. In particular, the preferred embodiment of this invention provides a pair of protrusions, at least one of the protrusions having a sharp knife-like edge, aligned immediately across the width of the index strip from each other and positioned near the mid-portion of the index strip.

In accordance with the present invention, at least one of the protrusions is spring-loaded such that it may be controlled to slidably engage the base of the index strip as desired. As the spring-loaded protrusion engages the index strip, the force of the spring causes the index strip to engage, or at least securely abut against, the other protrusion positioned immediately across the index strip from the spring-load protrusion. The engagement of these two protrusions with opposing sides of the index strip securely positions and aligns the index strip, and most notably, dependably maintains the desired position throughout the connectorization process. Therefore, the present invention discloses a tool having a holding bracket which alleviates the detrimental lateral swaying, rocking or bowing motion frequently encountered by the index strip during the operation of a tool for assembling multiple contact stackable connectors.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
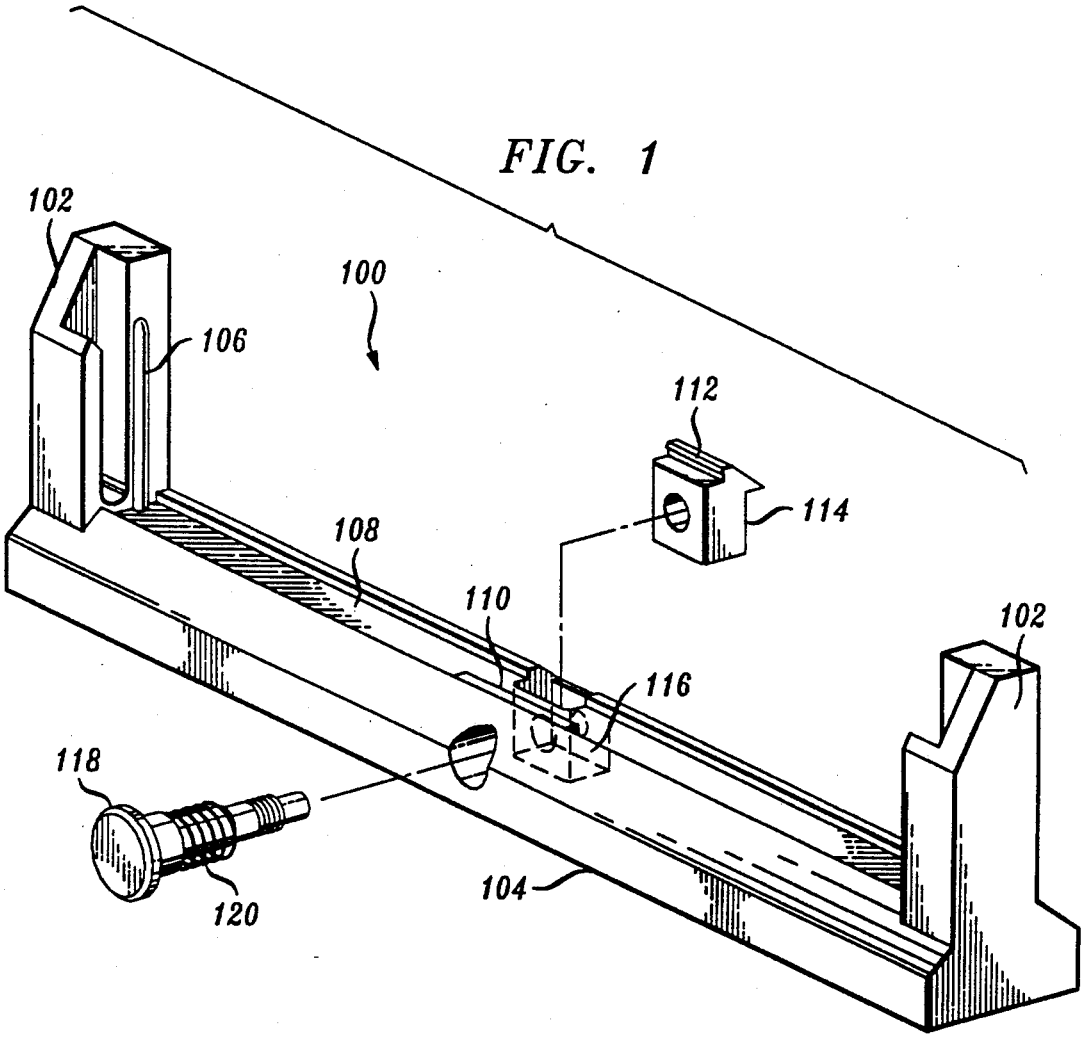
FIG. 1 is a perspective view of a holding bracket assembly in accordance with the present invention.
Figure 2:
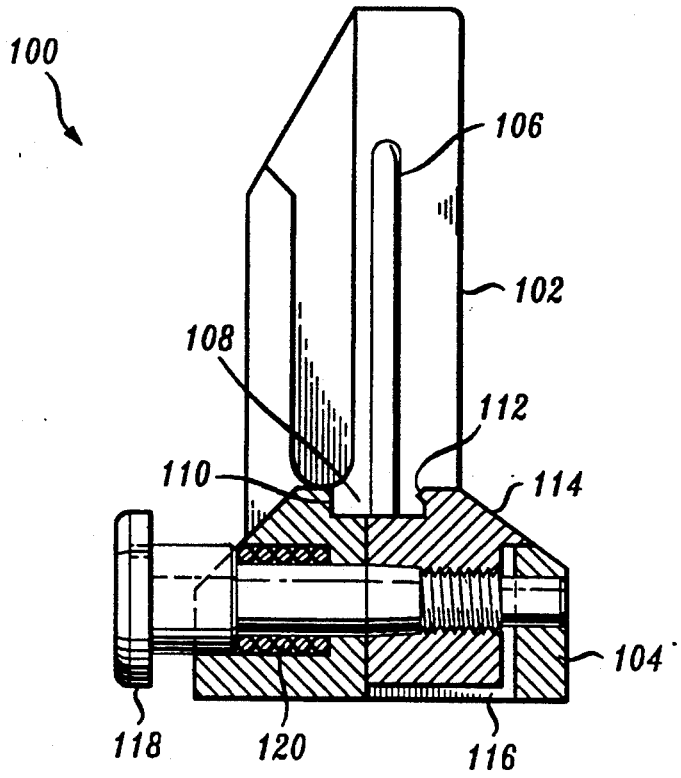
FIG. 2 is a side view of the spring-loaded, latch-type securing means utilized in the holding bracket assembly of the present invention.
Figure 3:
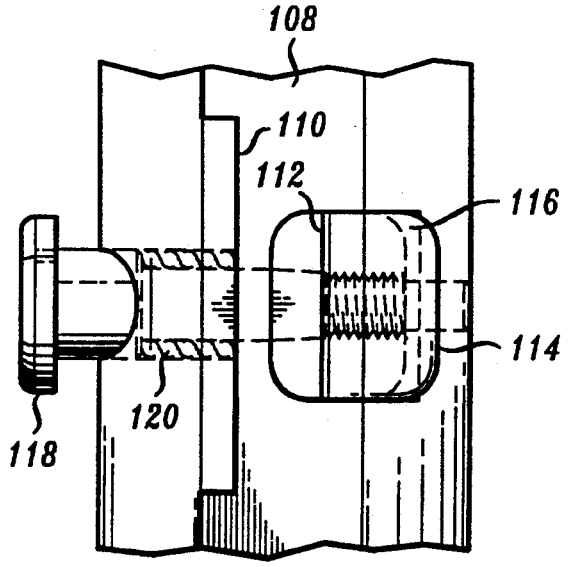
FIG. 3 is a top view of the spring-loaded, latch-type securing means utilized in the holding bracket assembly of the present invention.

The present invention relates to tool having an improved holding bracket illustrated in FIGS. 1-3 and designated generally by numeral 100. The tool 150 (FIGS. 5 and 6) and used to assemble multiple contact connectors and conductors. Throughout the industry, such electrical connections are accomplished using a device generally referred to as splicing connectors. An expanded depiction of a splicing connector is shown in FIG. 4 and designated generally by numeral 50.

The splicing connector 50 is disclosed and claimed in previously mentioned U.S. Pat. No. 3,858,158. In general and as illustrated in FIG. 4, connector 50 includes an index strip, designated generally by the numeral 52, a connector module, designated generally by the numeral 54, and a cap, designated generally by the numeral 56. The present invention is directed to a tool having an improved holding bracket 100 which comprises particular means to stabilize the index strip 52 and associated connector components 54 and 58. However, before specifically describing the elements and operation of the holding bracket 100 of the present invention, some details regarding a typical splicing connector 50 and its operation are set forth immediately below.

The connector 50 includes a plurality of slotted double-ended contact elements 58—58 for connecting together electrically at least one or more conductors 60—60 of a first group of conductors to associated conductors 62—62 of a second group of conductors. One end of each of the contact elements 58—58 is received in the index strip 52 when the connector module 54 is mounted thereon to electrically engage an associated conductor 60 held in the index strip. The other end of each of the contact elements 58—58 slices through insulation of an aligned one of the second group of conductors 62—62 when these conductors are seated in the connector module 54.

Figure 4:
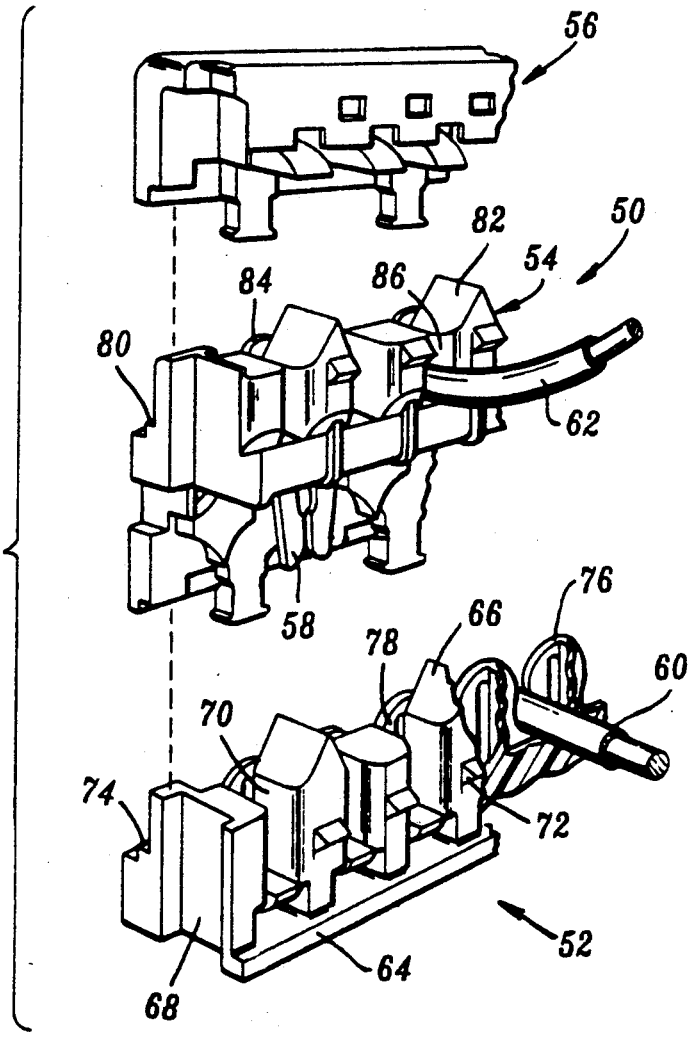
FIG. 4 is an exploded view of a multiple contact stackable connector suited to be held by the holding bracket assembly of the present invention.

As can best be seen in FIG. 4, the index strip 52 of connector 50 includes a base 64 having a plurality of spaced teeth 66—66 projecting vertically from the base 64 between grooved end walls 68—68 to form a plurality of conductor-receiving grooves 70—70. Each of the teeth 66—66 includes a nub 72 on one side surface thereto for securing the module 54 to the index strip 52. A platen surface 74 is formed lengthwise along the index strip 52 adjacent risers 76—76. The platen surface 74 serves as an anvil to facilitate the severance of ends of the first group of conductors 60—60 which extend beyond the index strip 52. In addition, the index strip 52 also incorporates a plurality of wells 78—78 which are formed between adjacent teeth 66—66 and risers 76—76 for receiving ends of the contact elements 58—58 at the connector module 54 when mounted on the index strip 52.

The second portion of the connector 50 is a connector module 54. The connector module 54, as alluded to above and illustrated in FIG. 2, is configured so as to be mounted or stacked on the index strip 52, includes a plurality of the contact elements 58—58. An upper portion of the connector module 54 terminates along a ledge 80 spaced below the platen surface 74 which, as stated earlier, serves as a conductor-cutting anvil. A plurality of latching openings (not specifically shown) open to a side wall of the connector module 54 to receive the latching nubs 72—72 of the index strip 52 to secure the connector module to the index strip. The connector module 54 also includes a plurality of teeth 82—82 and aligned risers 84—84 to form a plurality of conductor-receiving grooves 86—86 for holding the second group of conductors 62—62. The assembly of the connector 50 is completed with the addition of the cap 56. The cap 56 is assembled to the connector module 54 to protect the various portions of connector 50, especially conductors 62—62, from moisture and other environmental containments.

Figure 5:
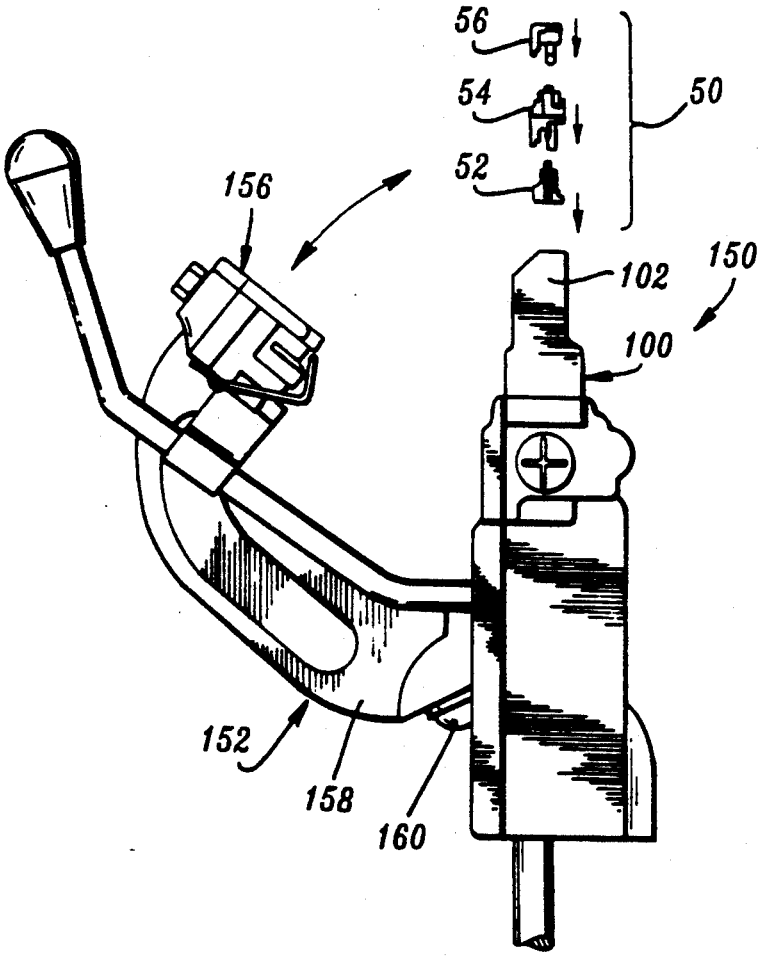
FIG. 5 is a perspective view of a tool for assembling multiple contact stackable connectors depicted in its open position.
Figure 6:
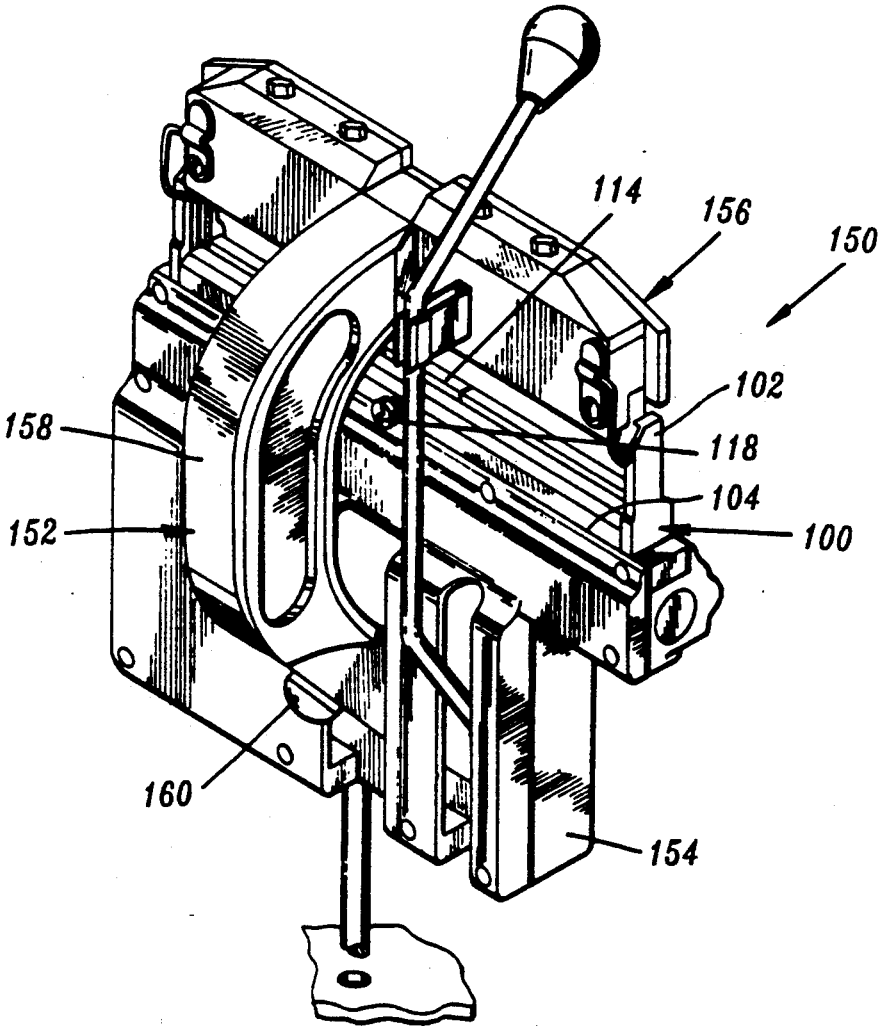
FIG. 6 is a perspective view of a tool for assembling multiple contact stackable connectors depicted in its closed position.

As stated earlier, various tools have been used in the past to assemble the elements of the connector 50 and the two groups of conductors 60—60 and 62—62 which are to be spliced together. FIG. 5 and FIG. 6 illustrate a tool 150 for assembling a modular connector. The operation of such a tool 150 is discussed in greater detail below.

Generally, the operation of such tools begins with an operator positioning an index strip 52 into a holding bracket assembly. However, as stated earlier, the holding bracket assemblies currently used do not alleviate the undesirable motion of the index strip 52 consistently enough to meet the requirements demanded by the precise connectorization process.

The present invention is directed to a tool having a holding bracket assembly 100 which includes oppositely disposed guides 102—102 that extend upwardly from each end of a support plate 104. A pair of ribs 106—106 protrude inwardly toward a centerline of the tool 150 to engage with the grooved end walls 68—68 of the index strip 52. The grooved end walls 68—68 are particularly molded into each end of the index strip 52 so as to accept the ribs 106—106 in a tongue-and-groove type manner. Such engagement at each end of the holding bracket 100 acts to secure the index strip 52 in the desired position within the tool 150.

In addition, the holding bracket assembly 100 of the present invention also comprises a shallow trough or extended recess 108 to provide further positional guidance for an operator inserting an index strip 52 into the tool 150. The extended recess 100 is slightly wider than the width of the base 64 of the index strip 52 and extends along the top of the holding bracket support plate 104 so as to be substantially aligned between the ribs 106—106. The physical configuration of the ribs 106—106 relative to the recess 108 establishes a precise insertion path to assist an operator in properly loading an index strip 52 into tool 150.

As stated earlier, the individual components of the connector 50 are subjected to a variety of different forces during the connectorization process. Due to the presence of these undesirable forces and the precision required to achieve a proper multiple conductor connection, it is critical that the movement of connector 50 during the connectorization process be minimized as much as possible. It is particularly important that the index strip 52 be adequately secured across the entire length of the holding bracket support plate 104 since the index strip 52 provides the bottom support for the entire connector 50, including the connector module 54 and the cap 56.

Furthermore, as the height of the connector 50 increases above the support plate 104, any motion of the index strip 52 becomes exaggerated throughout the connector 50. Such motion causes misalignment of the connector components 52, 54 and 56 as well as the individual conductors within both the first and second group of conductors 60—60 and 62—62 being combined. Due to the precision required throughout the connectorization process to achieve a proper conductor connection, any misalignment of the connector components 52, 54 and 56 or conductors 60—60 and 62—62 compromises the integrity of the ultimate multiple conductor connection created.

In order to alleviate the aforementioned problem, the present invention relates to a tool having a holding bracket assembly 100 which incorporates particular means to stabilize the index strip 52 and associated connector components 54 and 56. In general, the holding bracket of a tool in accordance with the preferred embodiment of the present invention comprises a slidably moveable securing means capable of engaging the index strip 52 so as to stabilize the connector 50 throughout the multiple conductor connecting process. Furthermore, the present securing means disclosed herein is capable of applying a securing force to each side of the index strip 52.

Specifically, the holding bracket assembly 100 in accordance with the present invention comprises at least one pair of protrusions 110 and 112, FIGS. 1–3, with at least one of the protrusions having a sharp knife-like edge. Preferably, the protrusions 110 and 112 are aligned immediately across the width of the index strip 52 from each other and positioned near the mid-portion of the index strip. In the preferred embodiment of the present invention, at least one of the protrusions depicted as element 112 of FIGS. 1–3, is spring-loaded such that it may be controlled to slidably engage the base 64 of index strip 52 when desired, in a manner specifically described in more detail below. However, protrusion 112 may be biased using any well known means including a cam or lever arrangement.

The particular details of the spring-loaded protrusion 112 are illustrated in FIGS. 1–3. As shown, the spring-loaded protrusion 112 extends from a holding bracket latch 114 and is positionable into a cavity 116 within the holding bracket support plate 104 such that the latch 114 is mounted in the support plate 104 and positioned at least partially under the extended recess 108. When embedded, the holding bracket latch 114 is connectable to a thumb screw 118 which preferably projects from the side of holding bracket support plate 104 in a manner that does not interfere with the operation of tool 150 and is easily accessible to an operator desiring to latch or unlatch the index strip 52 from the holding bracket assembly 100. The present invention provides means to continually cover the upper opening of cavity 116 throughout its entire range of movement.

A spring 120 is positioned around the shaft of thumb screw 118 to facilitate the spring-loaded action of the overall index strip securing means of the present invention. During operation, the particular configuration of the holding bracket latch 114, the thumb screw 118 and the spring 120 allows the spring-loaded protrusion 112 to be controllably moved between two positions. The normal bias of the spring 120 forces the thumb screw 118 away from the holding bracket support plate 104, thereby pulling the spring-loaded protrusion 112 into the extended recess 108. Therefore, to position an index strip 52 into extended recess 108, the spring-loaded protrusion 112 must be moved outside the recess 108. However, after an index strip 52 is positioned down into the extended recess 108 and there is no pressure applied to thumb screw 118, the spring-loaded protrusion 112 is caused to engage the base 64 of index strip 52.

In order to move the spring-loaded protrusion 112 outside recess 108, a pressure is introduced which forces the thumb screw 118 toward the holding bracket support plate 104, thereby causing the spring 120 to be compressed. As the spring 120 is compressed, the spring-loaded protrusion 112 slides out of the extended recess 108 thereby disengaging the spring-loaded protrusion from the index strip 52. Upon disengagement of the spring-loaded protrusion from the index strip 52, the index strip may be easily removed from the holding bracket assembly 100.

As the spring-loaded protrusion 112 engages one side of the index strip 52, the force of spring 120 causes the other side of the index strip to engage the other protrusion 110. As stated earlier, protrusion 110 is positioned immediately across the index strip 52 from the spring-loaded protrusion 112. Therefore, the index strip securing means within the holding bracket assembly 100 of the present invention applies a position-securing force to each side of the index strip 52.

Furthermore, to facilitate an adequate engagement between the index strip 52 and the protrusions 110 and 112, each of the protrusions is made of hardened stainless steel. It should be noted that any suitable non-yielding, rigid material may be used to construct the protrusions 110 and 112. Since the index strip 52 is generally constructed of a plastic material, the protrusions 110 and 112 may actually embed into the plastic base 64 of the index strip. Such embedment is especially true for protrusions which have a sharp, knife-like edge. By controllably applying such forces to the index strip, the holding bracket disclosed herein drastically alleviates the detrimental lateral swaying, rocking and/or bowing frequently encountered by an index strip during the operation of a hand-held multiple conductor connecting tool as described in the previously-mentioned prior art.

In the preferred embodiment of the present invention, protrusion 110 may be rigidly attached in a stationary position to the side of the extended recess 108 immediately opposite the spring-load protrusion 112. While it has been specified herein that the spring-loaded protrusion 112 has a sharp, knife-like edge, a main benefit of the present invention is attributable to the application of any position-securing force to the side of the base 64 of the index strip 52. It should also be noted that protrusion 110 may be any suitably hard portion which is properly aligned opposite the spring-loaded protrusion 112 so as to introduce a stabilizing force to the side of the index strip 52 opposite the spring-loaded protrusion 112. In one embodiment of the present invention, the stationary protrusion portion 110 comprises one or more pegs or screws made of hardened material, such as stainless steel, and properly aligned opposite the spring-loaded protrusion 112.

In addition, it should be noted that each of the oppositely aligned protrusions 110 and 112 may be spring-loaded without deviating from the scope of the present invention. Furthermore, it should be noted that a plurality of protrusions positioned along either side of the extended recess 108 is also deemed to be within the scope of the present invention disclosed and claimed herein.

The particular configuration of a tool 150 suitable for assembling multiple contact, stackable connectors in shown in FIG. 5 and FIG. 6. In addition to the holding bracket assembly 100 previously discussed, the tool 150 also includes force-applying facilities such as a T-bar assembly, designated generally by the numeral 152. During positioning of an index strip 52 into the holding bracket assembly 100, the T-bar assembly 152 is disposed laterally of a housing 154 as can best be seen in FIG. 5. The T-bar assembly 152 includes a head 156 which during each sequence of steps of the connectorization process is to be moved through a first incremental distance to engage a topmost connector element, which is held in holding bracket assembly 100. Furthermore, the head 156 is then moved through a second incremental distance to seat and cut conductor 60—60 and 62—62 or to assemble together connector elements 52, 54 and 56 in position on support plate 104. The tool 50 is self-compensating with respect to the combination of the first and second distances which vary because of the varying height of the connector elements 52, 54 and 56 on plate 104.

The T-bar assembly 152 is also mounted for pivotal movement between the positions shown in FIGS. 5 and 6 so that plate 104 is capable of being uncovered to receive the conductor elements 52, 54 and 56 as shown in FIG. 5. Such pivoting capability is provided by a connecting arm 158 which extends accurately from the head 156. The pivotal movement of the T-bar assembly 152 is limited by a button 160 which engages a lower portion of the housing 154. More particularly, details of the configuration and operation of tool 150 are disclosed in previously referenced U.S. Pat. Nos. 4,148,138, 4,282,644 and 4,382,644, which are expressly incorporated by reference herein. The specific operation of the hydraulic-based tool referenced earlier is substantially identical to the operation of hand-operated mechanical tools referenced immediately above and illustrated in FIGS. 5 and 6.

It is to be understood that the above-described arrangements are simply illustrative of the invention. Other arrangements may be devised by those skilled in the art which will embody the principles of the invention and fall within the spirit and scope thereof.

I claim:

1. A tool for assembling stackable elements to form a connector and for assembling conductors to the elements, which comprises:

means for supporting the connector during its assembly in which adjacently positioned elements are secured together to form a stack of elements and conductors are assembled to elements;

means for prohibiting undesirable movement of the lowermost connector element and maintaining alignment of the various elements of the connector by manipulating at least one protrusion into physical engagement with a side portion of the lowermost connector element;

means for applying forces to each successively stacked element positioned in the supporting means to secure it to an adjacent element previously positioned in the supporting means and for applying forces to conductors to assemble the conductors to the elements;

means for mounting said force-applying means for reciprocal movement which includes movement in one direction through first and then second incremental distances;

means for moving the means for applying forces through the first incremental distance to engage each successively stacked element and to engage conductors positioned in an element which is held in the supporting means and for then moving said force-applying means through the second incremental distance to secure conductors to an element; and means responsive to the movement of the means for applying forces through the first incremental distance and to the initiation of the movement through the second incremental distance for spacing said force-applying means a predetermined distance from the supporting means, said spacing means capable of compensating for the number of elements which are held in the supporting means to cause the movement of said force-applying means through the second incremental distance to be effective to secure together adjacent elements and to secure conductors to an element.

2. The tool of claim 1 wherein the physical engagement involves a portion of the protrusion becoming embedded into the side portion of the lowermost connector element.

3. The tool of claim 2 wherein at least one protrusion comprises a sharp, tapered edge as an initial point of physical engagement with the lowermost connector element.

4. The tool of claim 3 further comprising a second protrusion aligned opposite each of the sharp protrusions and capable of providing a position-securing force to a second side portion of the lowermost connector element.

5. The tool of claim 1 wherein the lowermost connector element is constructed of a plastic material and each of the protrusions is constructed of a hardened material.

6. The tool of claim 1 wherein at least one of the protrusions is spring-loaded with a normal bias that requires a pressure be applied to a spring to disengage the spring-loaded protrusion from the lowermost connector element.

* * * * *